United States Patent [19]

Muscatell

[11] 4,412,105

[45] Oct. 25, 1983

[54] LASER MICROPHONE

[76] Inventor: Ralph P. Muscatell, 2007 NE. 20th Ave., Fort Lauderdale, Fla. 33305

[21] Appl. No.: 355,898

[22] Filed: Mar. 8, 1982

[51] Int. Cl.[3] ..... H04R 17/02

[52] U.S. Cl. ..... 179/121 R; 455/614

[58] Field of Search ..... 455/614, 605; 179/138, 179/121 R, 121 T, 113

[56] References Cited

U.S. PATENT DOCUMENTS

| | | | |
|---|---|---|---|
| 2,173,994 | 9/1939 | Anderson | 179/121 |
| 2,259,511 | 10/1941 | Banks | 455/605 |
| 2,666,650 | 1/1954 | MacDonald | 274/27 |
| 3,433,959 | 3/1969 | Atwood et al. | 250/199 |
| 3,470,329 | 9/1969 | Young | 179/121 |
| 3,622,791 | 11/1971 | Bernard | 250/199 |

*Primary Examiner*—John C. Martin
*Assistant Examiner*—Edward L. Coles
*Attorney, Agent, or Firm*—Oltman and Flynn

[57] ABSTRACT

A microphone utilizing a laser light for conversion of acoustical sound waves to corresponding electrical signals which may, in turn, be amplified and processed for sound reproduction or recording. The microphone has a cylindrical outer housing with a plurality of circumferentially spaced openings for the entry of sound waves, a cylindrical inner housing positioned concentrically inside the outer housing, a laser for projecting laser light into the space between the outer and inner housings, and a plurality of photo detectors for receiving the sound-modulated laser light to produce electrical signals corresponding to the sound waves entering the openings in the outer housing.

37 Claims, 14 Drawing Figures

LASER MICROPHONE

BACKGROUND AND SUMMARY

Since the earliest times of electrical sound reproduction there has been a continued trend toward ever more realistic and distortion free sound reproduction and methods. Almost all microphones now in use employ some form of a physical diaphragm which is exposed to the sound waves and which in turn is coupled to some form of electrical receiver which translates the vibrations of the diaphragm into electrical signals which can be amplified in suitable amplifiers and connected to loudspeakers or sound recording equipment.

In the oldest form of microphone a diaphragm is connected to a small chamber filled with carbon granules which is traversed by an electrical current which is modulated by the variable resistance of the carbon granules. In more modern microphones the diaphragm is coupled capacitively through a small air space to one electrode of a small capacitor such that the capacitance is modulated by the vibrations of the diaphragm. In another class of microphones, the diaphragm is coupled to an inductor placed in a magnetic field such that the vibration of the diaphragm is translated into a low level alternating potential in the conductor.

It follows that whenever a physical diaphragm with even a small but finite mass is interposed between the sound waves and the electrical receiving apparatus, the physical properties of the diaphragm, such as mechanical resonances and standing waves have a distorting effect on the translation of sound waves into electrical signals.

Another source of loss of fidelity in electrical sound reproduction and recording systems stems from the fact that existing microphones have only one sound channel which may receive sound primarily from one direction or from many or all directions depending on the construction of the microphones, but a human being with binaural hearing and situated in an auditorium or listening room listening to a stage performance will hear sounds coming from all directions as sound waves are reflected from all surfaces of the room. For that reason the microphone according to the instant invention, in a preferred embodiment has a plurality of sound channels, which, when connected to a similar plurality of loudspeakers that are oriented in a configuration corresponding to the orientation of the individual sound channels of the microphone, may serve to produce sound reproduction that may have a degree of fidelity approaching that of a lifelike listening situation.

It is an important object of the instant invention to produce a microphone that uses laser beams such that the sound waves are sensed by means of phenomena relating to the interaction between sound pressure waves and a beam of laser light without an interposed physical diaphragm or, as in one embodiment, by a diaphragm or, as in one embodiment, by a diaphragm that may be of very small size and low mass which is not encumbered by mechanical resonances and standing waves encountered by the use of a diaphragm of the size normally used in microphones.

It is another important object of the present invention to produce a microphone utilizing phenomena related to the interaction between a beam of coherent laser light and acoustic sound waves to generate an electrical alternating signal which represents closely the alternating pressure of the sound waves, and such that a high degree of fidelity in the correlation between the sound wave and the resulting electrical signal is attained.

It is a further important object of the present invention to produce a microphone utilizing phenomena related to the interaction between a beam of coherent laser light and acoustic sound waves to generate a plurality of electrical signals, each signal representing closely the alternating pressure of a similar plurality of sound waves incident to the circumference of the microphone from a similar plurality of directions and such that all directions are separated by equal angles from each other in a generally horizontal plane.

It is another important object of the present invention to produce a microphone which is relatively easy to fabricate in large numbers without undue complexity and difficulty in the manufacture thereof.

DETAILED DESCRIPTION

Figure 1:
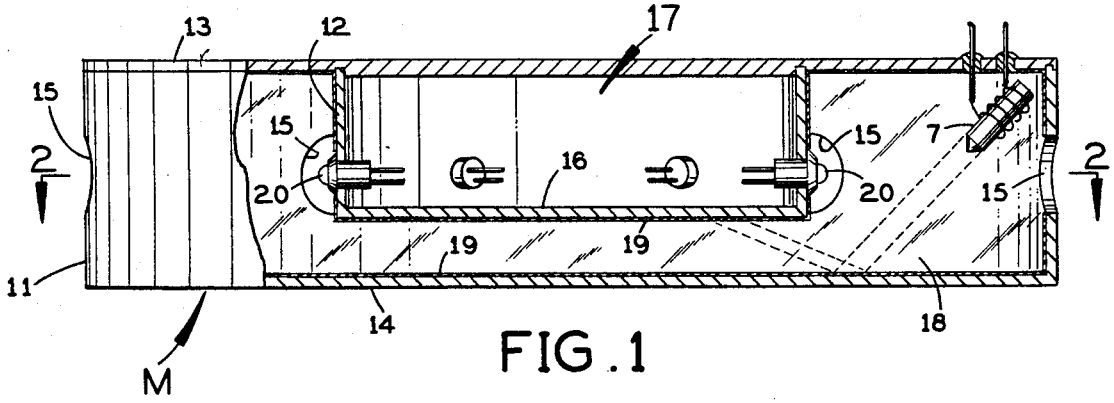
FIG. 1 is a part elevational, part cross-sectional vertical view of the laser microphone in its first preferred embodiment along the line 1—1 of FIG. 2.
Figure 2:
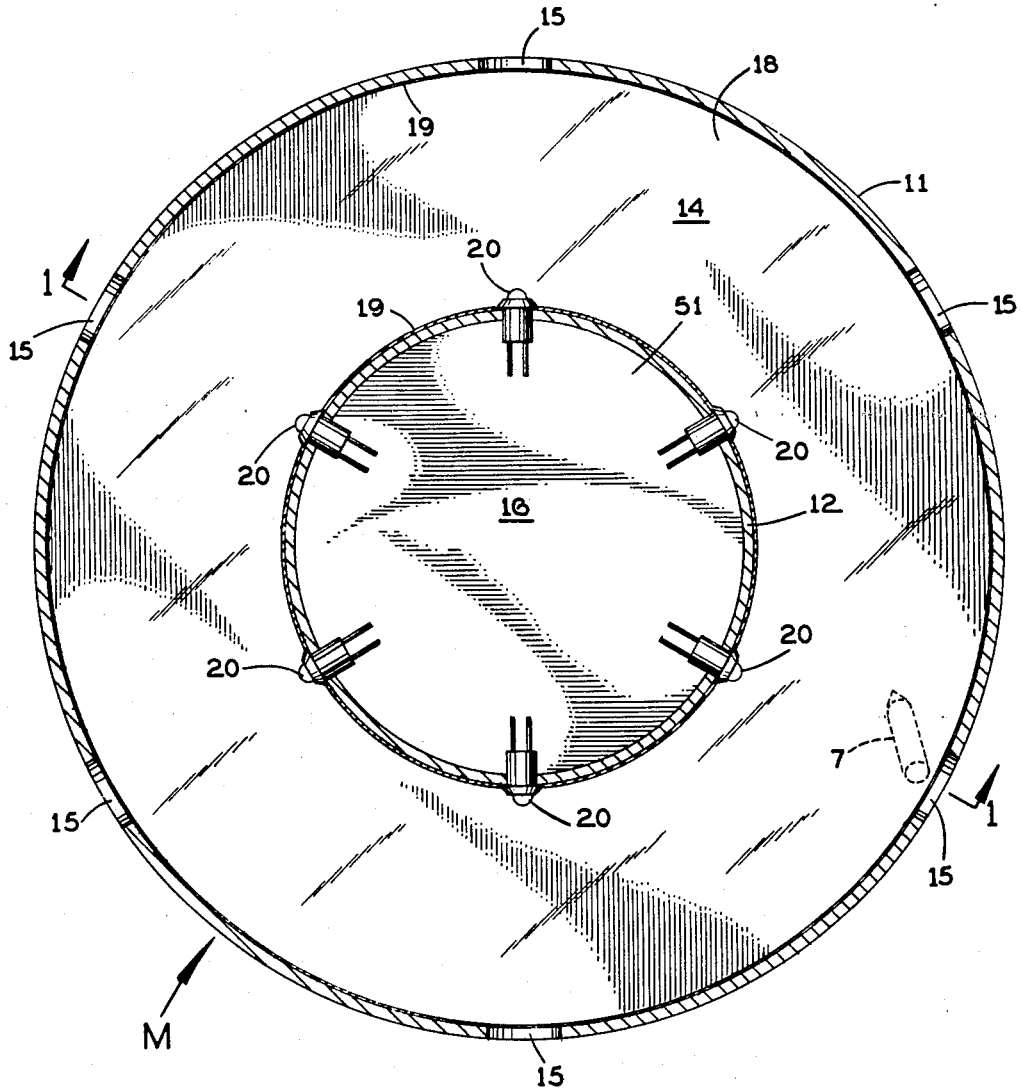
FIG. 2 is a cross-sectional, horizontal view of the laser microphone in its first preferred embodiment, along the line 2—2 of FIG. 1.

In the first preferred embodiment of the present invention shown on FIGS. 1 and 2 diffused coherent laser light is modulated in intensity by the alternating air pressure of sound waves incident to the microphone.

The modulation is based on the effect that absorption of light in atmospheric gas is very pronounced at certain sharply defined wave lengths. In addition it can be shown that the degree of absorption, besides being a function of the wave length of the light, is a linear function of the density of the atmospheric gas.

Light with wave length at approximately 4,500 angstroms or 35,000 angstroms as emitted by infrared lasers or 6,945 angstroms as emitted by the ruby laser is especially subject to atmospheric absorption.

FIG. 1 and FIG. 2 show the general construction of the microphone in accordance with the first preferred embodiment of the invention utilizing absorption of light by atmospheric gas.

The main body of the microphone M consists of two concentric generally cylindrical sections of tubular wall 11 and 12. An upper and a lower circular endplate 13 and 14 serve to enclose the microphone and support the internal elements. The outer cylindrical wall 11 contains six equidistant generally circular apertures 15 spaced 60 degrees apart. The inner tubular wall 12 is attached to the lower surface of the upper cylindrical plate 13, and is bounded at its lower end by a circular plate 16, such that the plate 16 is disposed in a horizontal plane between the plates 13 and 14. The outer cylindrical wall 11 and endplates 13 and 14 define an outer housing. The inner cylindrical wall 12 and its endplates 13 and 16 define an inner housing enclosing a cylindrical inner cavity 17. The outer and inner housings define a space 18 between them which extends around and below the inner housing.

All the inner surfaces of the outer space 18 are coated with a mirror coating 19 which has a high degree of reflectivity at the wave length of light generated by a laser 7 disposed inside the space 18. The laser 7 is positioned inside the space 18 in such a way that the beam of parallel coherent monochromatic laser light is reflected back and forth repeatedly between all the inside surfaces of the space 18 thereby filling the space completely with diffused light. It has been found by analysis that best results are obtained with a laser oriented such that its axis is at oblique angles to both the horizontal plane and a vertical plane defined by the vertical axis of the microphone. Part of the light escapes through the apertures 15, and part is absorbed by the reflecting surfaces, which, although of a high degree of reflectivity, do present some finite loss. In one version of the invention the laser is selected with such a high power rating that the air inside the cavity is brought to flourescence thereby adding more light to the amount of diffused light filling the space 18.

The laser is selected as a type that emits light of a wave length which is absorbed to a high degree by air.

Six light sensing photo detectors 20 are mounted in the inner tubular wall 12 with each photo detector 20 positioned opposite one of the apertures 15, with the light sensitive window of the photo detector facing radially outward.

Figure 3:
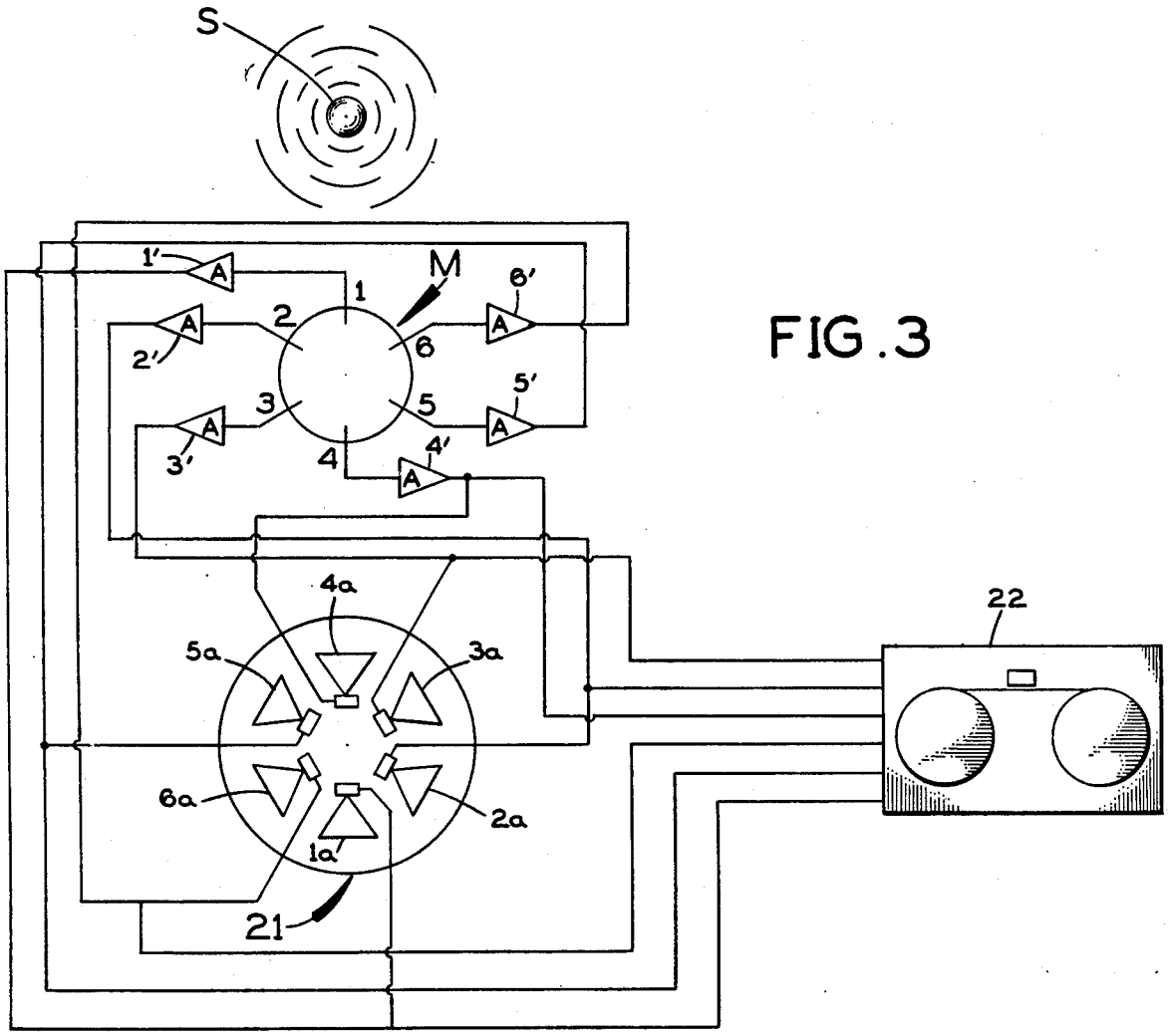
FIG. 3 is a diagrammatic, horizontal view of a microphone system with a source of sound and associated loudspeakers.

In operation of the laser microphone in accordance with the present invention in its present first preferred embodiment, FIG. 3 shows a sound source S radiating sound wave energy into the space ambient to the sound source. Part of the sound energy enters the circular space 18 inside the microphone M through apertures 15 and produces in said space alternating pressure changes in accordance with the wave shape of the radiated sound waves. Due to the choice of wave length of the laser beam such that maximum absorption of light is taking place and further, due to the fact that absorption of the light is a linear function of the alternating air pressure, the intensity of the light received by the photo detectors 20 will be alternating in exact conformity with the shape of the incident air waves, such that the electrical signal produced by each of the six photo detectors 1,2,3,4,5 and 6 in FIG. 3 is an exact reproduction of the incident sound waves. Each photo detector is connected to a corresponding amplifier 1',2',3',4',5' or 6' which serves to amplify and process the signal for reproduction in a suitable loudspeaker assembly 21 having six speakers 1*a*, 2*a*, 3*a*, 4*a*, 5*a* and 6*a*, or in a recorder 22 having six input channels. In the loudspeaker assembly, each individual loudspeaker (e.g., 1*a* or 2*a*) receives the amplified signal from the correspondingly numbered individual photodetector (e.g., 1 or 2) and broadcasts that signal, so that the overall effect approaches the realism of what a person would hear if positioned where the microphone M is in FIG. 3.

Figure 3A:
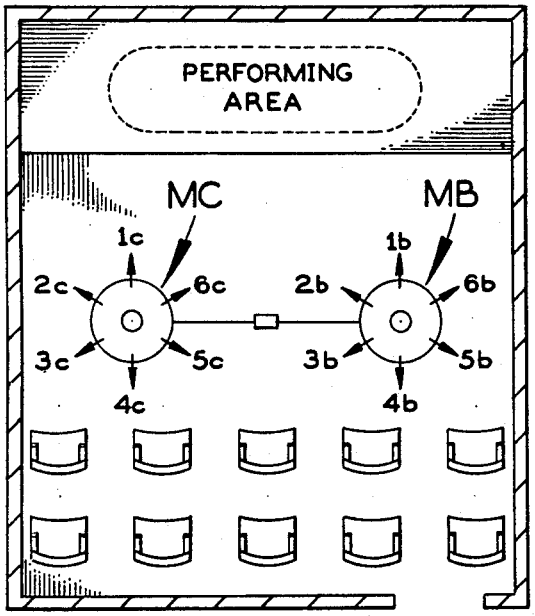
FIG. 3*a* is a diagrammatic view of an auditorium and a performing area with a microphone system installed therein.

FIG. 3*a* shows two microphones MB and MC at laterally spaced locations in front of the performing area, such as for an orchestra, in an auditorium. Each of these microphones may be constructed as shown in FIGS. 1 and 2, presenting six sound input openings at 60 degree intervals circumferentially in a horizontal plane and six corresponding photodetectors, numbered 1 through 6 for each microphone and with the "b" or "c" suffix for that particular microphone.

Figure 3B:
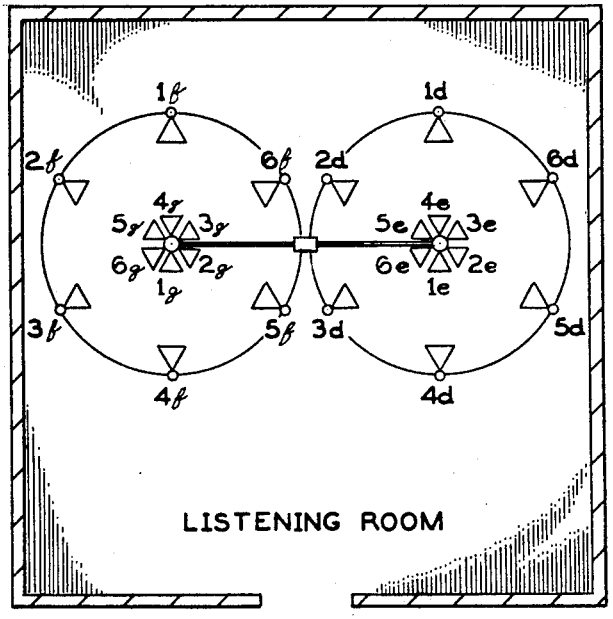
FIG. 3*b* is a diagrammatic view of a listening room with a loudspeaker system connected to a microphone system as shown in FIG. 3*a;*

FIG. 3*b* shows two loudspeaker assemblies in a listening room. The first loudspeaker assembly has an outer ring of speakers 1*d*, 2*d*, 3*d*, 4*d*, 5*d* and 6*d* spaced apart circumferentially at 60 degree intervals and each facing inward, and an inner ring of speakers 1*e*–6*e* concentric with the outer ring and spaced apart circumferentially at 60 degree intervals and each facing outward. The outer and inner speakers 1*d* and 1*e*, which face in the same direction, receive the amplified signal from photodetector 1*b* in microphone MB in FIG. 3*a*, the speakers 2*d* and 2*e* receive the signal from photodetector 2*b*, and so on.

The second loudspeaker assembly in the listening room has a similar outer ring of speakers 1*f*–6*f* and a similar ring of speakers 1*g*–6*g*, with the correspondingly numbered speakers facing in the same direction and connected through an amplifier to the corresponding numbered photodetector in microphone MC in FIG. 3*a*. For example, speakers 1*f* and 1*g* are connected to photodetector 1*c*, and so on.

In each speaker assembly, the speakers in the inner ring preferably are connected to the corresponding microphone outputs through suitable time delay devices so that the sound will reach the listener substantially simultaneously from the outer and inner speakers of each correspondingly numbered pair.

Figure 4:
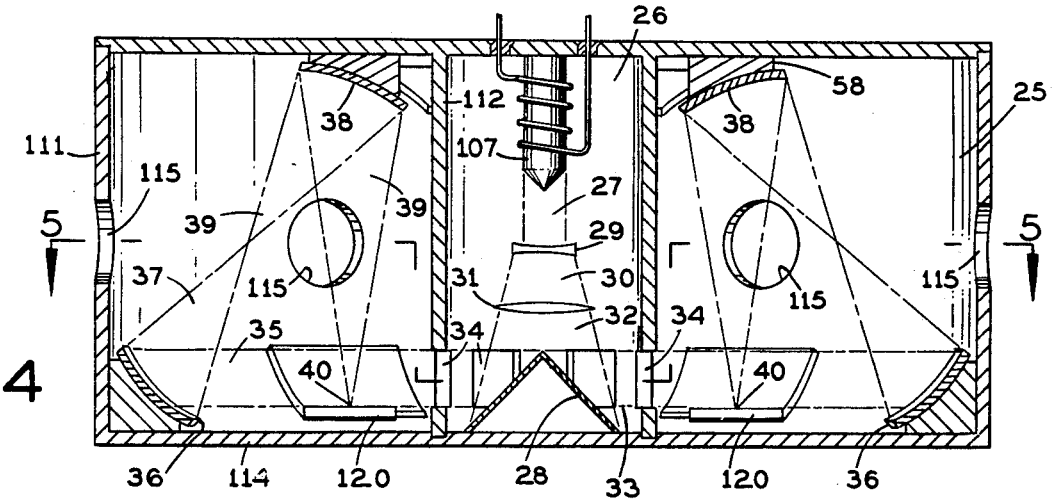
FIG. 4 is a cross-sectional vertical view of a laser microphone in its second preferred embodiment, along the line 4—4 of FIG. 5.
Figure 5:
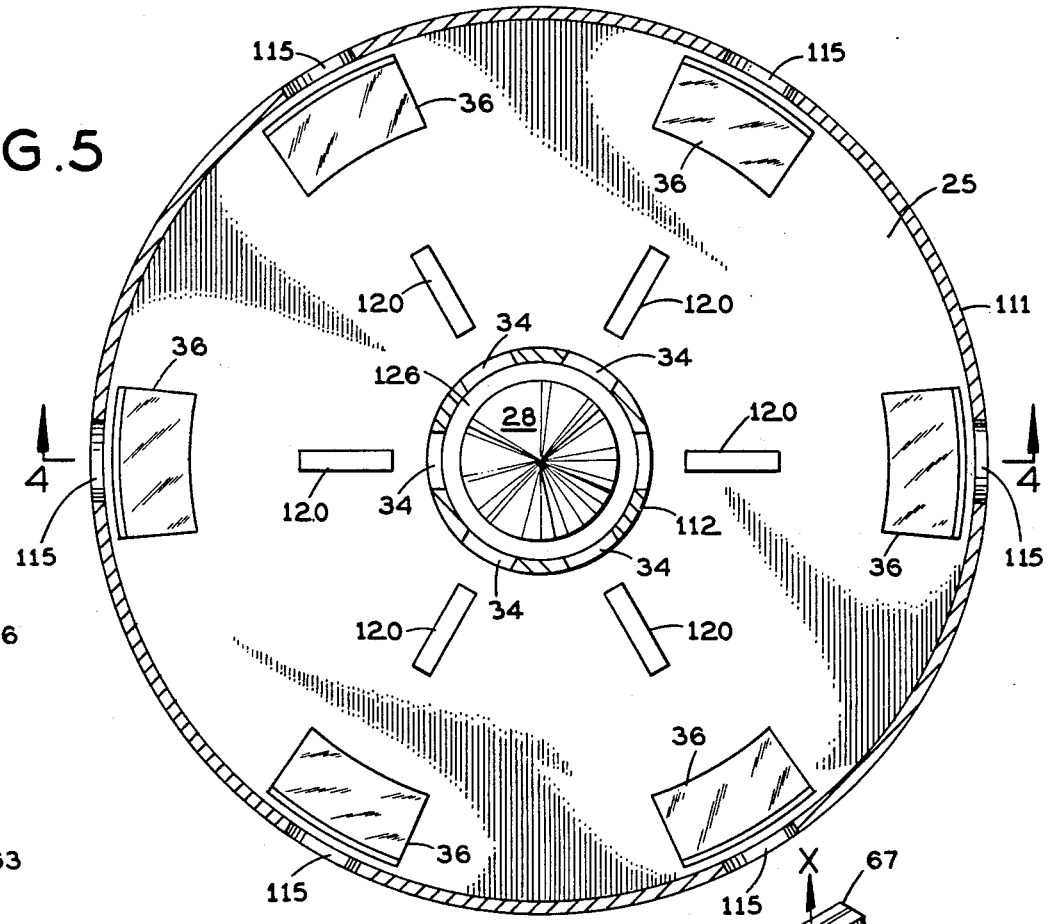
FIG. 5 is a cross-sectional, horizontal view of a laser microphone in its second preferred embodiment, along the line 5—5 of FIG. 4.

FIGS. 4 and 5 show a second preferred embodiment of the present invention. In this embodiment the mechanical configuration has elements that are similar to those shown in FIGS. 1 and 2 and are given the same reference numerals plus 100 as the corresponding elements in FIGS. 1 and 2. In FIG. 4, for convenience of illustrating the principle of operation of the microphone, its vertical dimension is shown somewhat greater and its horizontal dimension is shown somewhat smaller than what may be the optimum proportion between the vertical and horizontal dimensions for most effective operation.

An outer tubular wall 111 with an upper horizontal circular endplate 113 and a lower horizontal circular endplate 114 defines an outer toroidal cavity 25 which surrounds an inner tubular wall 112 disposed coaxially with the outer tubular wall 111. The inner tubular wall 112 defines an inner cylindrical space 26 which is also bounded by aforesaid upper and lower endplates 113.

A laser 107 is positioned vertically and coaxially within the aforesaid inner space 26. This laser is attached to the upper endplate 113 and projects downward from it. The laser emits a beam 27 of parallel coherent monochromatic laser light of such a wave length that a beam of this light exhibits a high degree of refraction in ambient air when traversing a pressure gradient, such as that produced by a sound wave. Positioned also coaxially with the inner space 26 and attached to the lower endplate 114 is a right circular cone 28 with its apex at the top, facing toward the laser. The side of the cone is defined by a line through its apex oriented downward at an angle of 45 degrees from the horizontal plane. The surface of the cone is coated with a material having a high degree of reflectivity at the wave length emitted by the laser 107, such as silver, aluminum or other highly reflective material.

The vertical light beam 27 traverses two optical lenses disposed horizontally below the laser 107. The first lens 29 is a concave lens which spreads the heretofore parallel rays of the beam so that the light exiting downward from the lens form a diverging beam 30, which next traverses the second lens 31 positioned a certain distance below the lens 29 and which is a convex lens of such a curvature that the rays of light again become parallel, forming the beam 32 which now has attained a cross-sectional area which is larger than the cross-sectional area of the original beam 27.

The light beam 32 is reflected by the cone 28 such that the reflected pattern of light 33 is shaped like a horizontal disc. Six identical rectangular apertures 34 disposed equidistantly in a horizontal plane in said inner tubular wall 112 admit six beams of light 35, projecting radially and separated by 60 degree angles, in a horizontal plane from the reflecting cone 28. Each aperture 34 has a vertical dimension substantially greater than its horizontal dimension, so that each light beam 35 emerging from an aperture 34 is similarly oblong in cross-section. Six first concave curved mirrors 36 are disposed along the inside perimeter of the outer tubular wall 111 near the lower endplate 114 such that each mirror intercepts one of the horizontal light beams 35 and reflects it upward in a vertical plane defined by the common axis of said tubular walls 111 and 112 and in a direction such that the reflected light beams 37 are intercepted by six second curved concave mirrors 38 disposed along the outer perimeter of aforesaid inner tubular wall 112, near aforesaid upper endplate 113.

The second concave mirrors 38 are oriented such that they reflect the beams of light 37 in a downward direction as beams 39 and project them onto six photo detectors 120.

The curvature of aforesaid six first concave mirrors 36 is such that the reflected beams of light 37 are brought to a line of convergence 39 positioned generally midway between aforesaid upper and lower endplates 113 and 114. After traversing the line of convergence 39 the rays of light beam 37 again become diverging. The curvature of aforesaid six second curved mirrors 38 is such that the light beams, after being reflected the second time as beams 39, are again converging and such that the new line of convergence is positioned at the center of elongated photo detectors 120, at right angles thereto.

The laser microphone of the present second preferred embodiment utilizes the phenomenon of refraction of light beams. Refraction of a beam of light takes place whenever the beam traverses a space where the matter in the space presents varying degrees of density along surfaces that are at an oblique angle to the beam of light. Refraction of light is a well known phenomenon and is described in the literature of optical physics, such as: Laser Technology by Hrand M. Muncheryan, published by Howard W. Sams & Co., Inc., and which has Library of Congress Catalog number 79-62989.

Refraction causes a beam of light to be bent a certain angle from its original direction. Sound waves which represent adjacent parallel traveling surfaces of varying alternating high and low pressure in air when traversing a beam of light at an oblique angle will cause that beam of light to be refracted. The degree of refraction will be proportional to the degree of pressure change in the sound wave.

In the present preferred second embodiment of the invention sound waves enter the toroidal space 25 defined by the tubular walls 111 and 112 through six equidistantly spaced circular apertures 115 disposed in the outer wall 111 such that the longitudinal centerline of each aperture 115 lies in a radial plane defined by the vertical axis of the microphone and by the center of each of the six rectangular apertures 34 in the inner tubular wall 112 and further such that each of the apertures 115 is located generally midway between the upper and lower endplates 113 and 114.

In this position sound waves entering the six apertures 115 from six different directions will traverse the space 25 in a radial direction, and such that the sound waves traverse the light beams 37 at an oblique angle generally near the line of convergence 39. In this case the light beams will be refracted from their original direction a small angle in the vertical plane, the degree of which is proportional to the pressure changes caused in the air by the sound waves entering each of the apertures 115.

As described above, the light beams, after being reflected the second time from said second curved mirrors 38, again converge. The curvature of said second curved mirrors 38 is such that the light beams converge again at a line perpendicular to the axis of aforesaid six photo detectors 120 disposed near the lower endplate 114.

Each of said six photo detectors 120 is oriented such that its axis is defined by the line of intersection of two planes, the first of which is a vertical plane defined by the vertical axis of the microphone and the center of the corresponding aperture 34 in the inner tubular wall 112, and the second of which is a plane through the center of said photo detector 120 and perpendicular to a line from the center of the corresponding second curved mirror 38.

In the quiescent state when no sound waves are entering the microphone's inner space all light beams will be at rest with the line of convergence of light in the form of a rectangular bar of light at the center of each of the six photo detectors. The photo detectors are of a special construction which is described in greater detail later in this specification, but briefly stated they operate to produce an electrical signal, the strength of which is linearly proportional to the distance the light rectangle is removed from the center of the photo detector. This type of photo detector is in the present disclosure designated a position sensitive photo detector as opposed to the intensity sensitive photo detector described with the first preferred embodiment, FIGS. 1 and 2.

Figure 6:
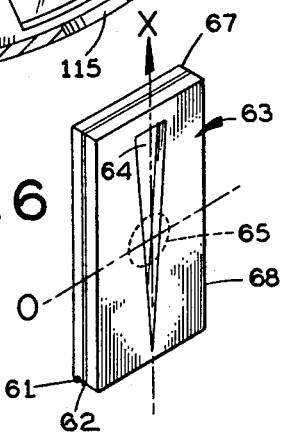
FIG. 6 is a perspective view of a position sensitive photo detector with a single wedge shaped light sensitive area, also showing an x-axis and a light dot.

Two versions of the position sensing photo detector will be described next. One version of said photo detector is shown in FIG. 6 in a perspective view and in FIG. 7 in a side view. The detector has a rectangular body 63 consisting of a conducting base material 67 of aluminum or other suitable electrically conductive material with a layer of light sensitive material 66 deposited thereon. This light sensitive material may be selenium or any other suitable light sensitive material. When the selenium layer is exposed to light the selenium becomes electrically conductive at a rate which is proportional to the intensity of the light. This light sensitive property of selenium is well known to the art of electric science and has been used in many applications. A mask 68 of an opaque, non-conductive material is disposed on top of the selenium layer. Said mask contains a wedge shaped longitudinal aperture 64.

The position sensitive photo detector operates as follows: a light dot 65, shown with a generally circular dotted outline is initially, as shown, at rest at the center of the wedge-shaped aperture. It should be noted that the light dot may also appear as a concentrated line of light across the active surface of the photo detector, instead of the round dot. In this position, part of the light from the light dot is admitted through the aperture to the selenium layer. The selenium so exposed becomes conductive and assumes a resistance value R(i) ohms. Assuming the light spot is moved vertically upward to a new lighted position, due to the increasing width of the wedge-shaped opening, more light will be admitted to the selenium layer which becomes still more conductive and assumes a still lower resistance value which in its most extreme upper position becomes R(1) ohms. Conversely, if the light spot is moved downward to a new lower position less light will be admitted and the resistance of the selenium becomes higher. In its most extreme lower position the resistance will become R(h). Since the change in resistance is linearly proportional to the position of the light spot it follows that $$R(i)=\tfrac{1}{2}(R(1)+R(h)) \quad (1)$$

and that the resistance of the detector is a function of the position X of the light spot. Assuming that the light spot moved in an alternating sinusoidal motion on the linear path described by the X-axis, the position of the light spot may be expressed as $$X=C_{(1)}\mathrm{Sin}(\omega t+\phi) \quad (2)$$

where $C_{(1)}$ represents the maximum excursion of the light spot from its rest position at X=0, where $\omega$ is the angular velocity of the alternating motion, $\phi$ is an arbitrary fixed phase angle, and t is time.

Since the resistance R(t) of the motion sensing photo detector is a linear function of the position (x) of the light dot, which is again a function of time t, it follows that the resistance may be expressed as a function of t as:

$$R(t)=\tfrac{1}{2}(R(h)-R(1))\sin(\omega t+\phi)+\tfrac{1}{2}(R(h)+R(1)) \quad (3)$$

Figure 7:
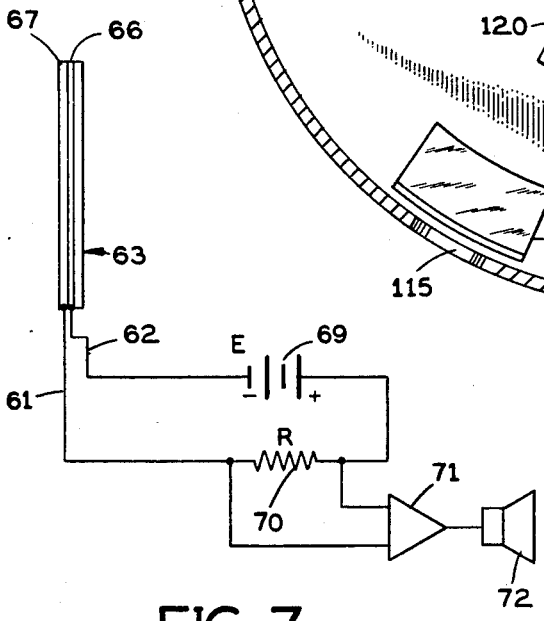
FIG. 7 is a circuit diaphragm of a position sensitive photo detector with a single wedge shaped light sensitive area, also showing a voltage source and a loudspeaker and other circuit elements.

In order to translate the alternating motion of the light dot into an electrical signal which is proportional to the motion, electrical circuitry as shown in FIG. 7 in circuit schematic form having a voltage source 69 of the potential E volts is connected through a resistor 70 with the resistance R ohms, through two conducting leads 61 and 62 to the base 61 and the selenium layer 62 respectively. It follows from the laws of electricity that a current I(t) amps will flow through the resistor 10 such that $$I(t)=\mathrm{E}/(R+R(t))\ \text{amps} \quad (4)$$

and that a signal voltage E(t), proportional with the position of the light dot will be generated across the terminals of the resistor R such that $$(E(t)=RI(t). \quad (5)$$

Combining (4) and (5) above it is seen that $$E(t)=ER/(\mathrm{R}=\mathrm{R}(t))\ \text{volts} \quad (6)$$

The signal voltage E(t) is, as shown in FIG. 7, connected to an amplifier 71 which will amplify the signal for reproduction by loudspeaker 72.

Figure 8:
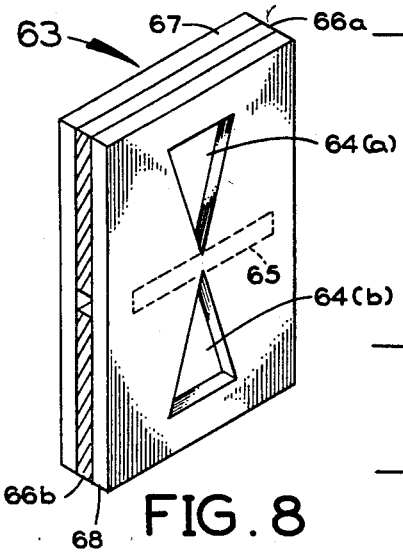
FIG. 8 is a perspective view of a position sensitive photo detector of a type having two opposing wedge shaped light sensitive areas, also showing an x-axis and a light dot.
Figure 9A:
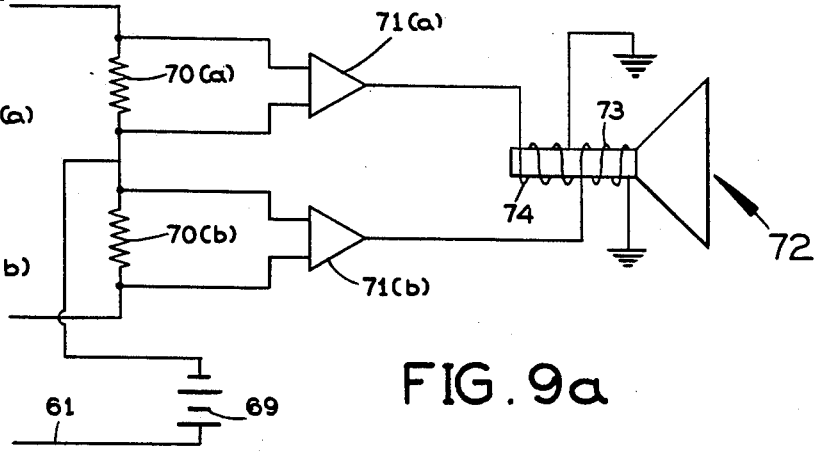
FIG. 9*a* is a circuit diaphragm of the circuit of FIG. 9 adapted to drive a loudspeaker with two windings.
Figure 9:
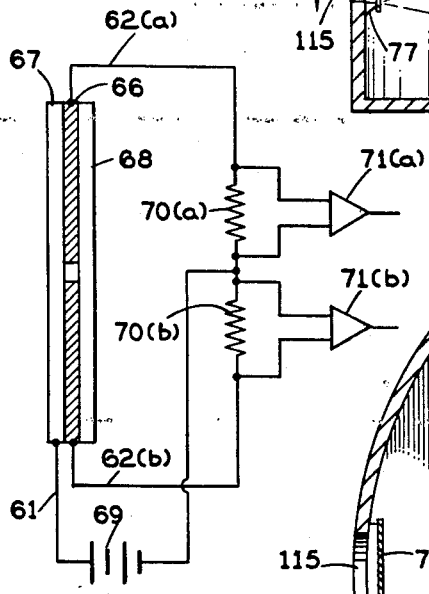
FIG. 9 is a circuit diaphragm of a position sensitive photo detector of FIG. 8, also showing a voltage source, and other circuit elements.

An alternative version of the motion sensing photo detector is shown in FIGS. 8 and 9, where 8 is a perspective view and FIG. 9 is a side view. Most of the elements of the alternative version are similar to those of the first version shown in FIGS. 6 and 7, but some of the elements have become duplicated as an upper and lower element. The duplicate elements are shown with the same reference numerals but with suffix letters a and b designating the upper and lower element respectively. In the alternative version of the photo detector two opposing wedge-shaped apertures 64(*a*) and 64(*b*) are used and each aperture covers each of two separate layers of selenium 66(*a*) and 66(*b*) sharing the same base 67. A lead 61 connects the base with the positive terminal of voltage source 69, and leads 62(*a*) and 62(*b*) connect resistors 70(*a*) and 70(*b*) with each of the two selenium sections 66(*a*) and 66(*b*) respectively. Resistors 70(*a*) and 70(*b*) have a common terminal connected to the negative terminal of voltage source 69. The light dot 65 is shown at its rest position at X=0 on the X-axis, which is also at the apex of the two wedge-shaped apertures. It follows, from the description and analysis of the first version of the position sensing photo detector, that the alternative version essentially consists of two electrically opposing complementary units of the first version. As the light dot is moved in an alternating linear motion along the path described by the X-axis between its extreme upper and lower points, the resistance of the upper and lower section of the selenium layer will vary such that the decrease is a linear function of the excursion of the light dot from its rest position. Assuming the light dot is moving in an alternating sinusoidal motion, the upper section of the detector will provide the upper half waves of the resulting electrical signal, while the lower section will provide the lower half waves such that the two half waves combine to form a full sinusoidal signal. Each half wave is in turn connected to each of two amplifiers 71(*a*) and 71(*b*), which together may drive a loudspeaker or recording device in a manner well known in the art of audio amplifiers as push-pull operation.

An improved method of connecting the two amplifiers 71(*a*) and 71(*b*) to a loudspeaker is shown in FIG. 9*a*, where the loudspeaker 72 is equipped with two cooperating drive coils 73 and 74. As is well known from the art of sound reproduction, a conventional loudspeaker consists of a circular, low mass cone equipped with a coil of fine wire wound on a tube attached to the cone. The coil is positioned in a cylindrical magnetic field such that magnetic lines of force project radially through the coil in a direction perpendicular to the axis of the coil. In the present improved method the conventional single coil is divided into two separate oppositely wound coils 73 and 74, where coil 74 is connected from the output terminal of amplifier 71(*a*) to ground potential and coil 40 is similarly connected from the output of amplifier 71(*b*) to ground potential. It should be noted that while the improved loudspeaker arrangement as described employs two coordinated amplifiers where each amplifier has its output terminal returned to ground potential other types of amplifiers are known where each is arranged such that their output terminals are returned to some suitable d.c. potential.

In operation, the two coils, being wound in opposite directions, and driven by two coordinated amplifiers 71(*a*) and 71(*b*) will seek to move the cone in opposite directions such that, in combination the two coils together will move the cone in a motion that is directly proportional with the original sound wave received by the microphone.

The two versions of the motion sensing photo detectors described above are explained by the use of a layer of selenium deposited on a conducting base. There are several other light sensitive arts that can be used within the scope of the present invention to achieve the same results by means of a single or two opposing wedge-shaped aperture masks covering the light sensitive area. Among such other arts are the use of a photo sensitive junction of two semi-conductors such as used in photo diodes, or the use of a photo cell in vacuum, in which cases the active areas of the device would be covered by aforesaid masks.

It follows that instead of the use of masks with wedge-shaped apertures, the photo sensing area of the photo sensing device may be shaped as a wedge and the same results attained.

Figure 10:
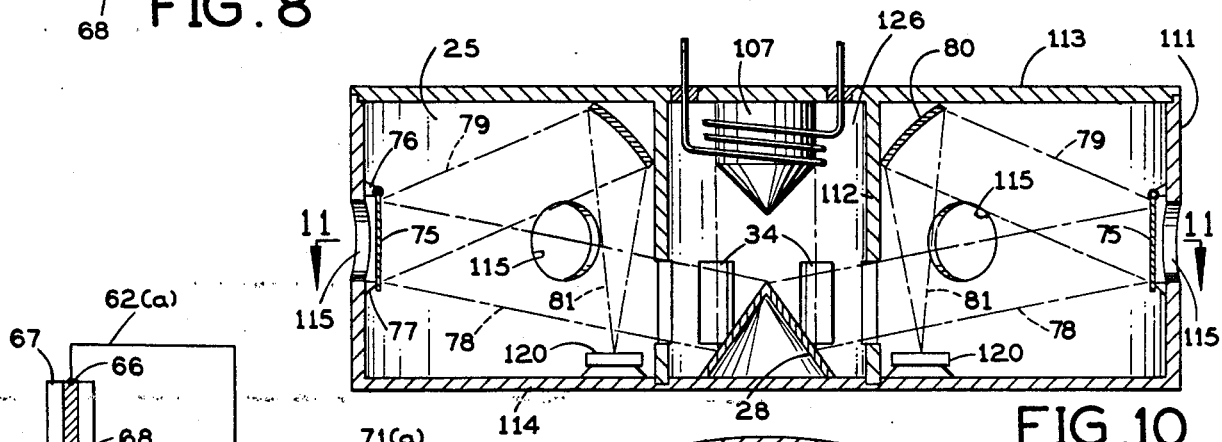
FIG. 10 is a cross-sectional, vertical view of a laser microphone in its third preferred embodiment along the line 10—10 of FIG. 11.
Figure 11:
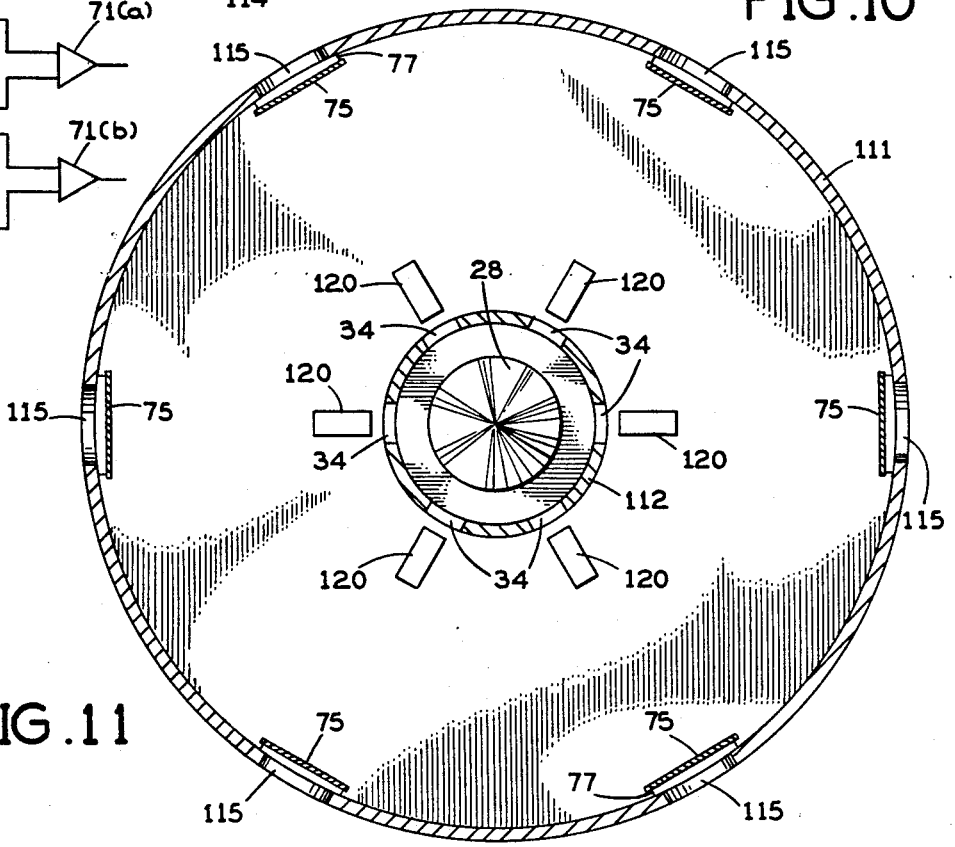
FIG. 11 is a cross-sectional horizontal view of a laser microphone in its third preferred embodiment along the line 11—11 of FIG. 10.

In the following section of this specification, a third preferred embodiment of the present invention will be described. This third embodiment is shown in FIGS. 10 and 11.

The mechanical structure of the third embodiment is generally similar to that of the second embodiment (FIGS. 4 and 5). FIGS. 10 and 11 therefore show the same reference numbers for the elements that are identical, such as the outer and inner tubular walls 111 and 112 respectively, and so forth. For the sake of brevity the description of the mechanical structure for FIGS. 4 and 5 shall be referred to for this embodiment as well. FIG. 10 shows a cross-sectional view of FIG. 11 along the line 11—11 and FIG. 11 shows a cross-sectional view of FIG. 10 along the line 10—10. In this third embodiment, as before, a laser 107 is disposed coaxially as shown on FIG. 10 with the central axis of the inner circular chamber 126. A straight beam of coherent laser light is projected vertically downward to the reflecting cone 28, from where the light is reflected in a generally horizontal disc shaped body of light. At the inside perimeter of the outer tubular wall 111 are disposed six mirrors 75, each of which is positioned just inside, and in radial alignment with, a corresponding opening 115 in the outer wall 111. Each mirror is constructed of a low mass, silvered material of high reflectivity, such as mica, thin aluminum, silver or any other suitable material.

Each mirror is suspended in space by at least two support elements 76 and 77, where support element 76 functions as a hinge that allows the mirror to pivot about the axis of the hinge, while support element 77 provides mechanical damping of the mirror such that there will be no mechanical resonances of the mirror in the sound spectrum of interest. The damping element 77 may be constructed of a material with high internal damping, such as felt, sponge rubber, foam or other suitable material.

Six generally rectangular apertures 34 in the inner tubular wall 112 admit six beams of light 78 to be projected onto the mirrors 75. These beams are again reflected as beams 79 by said mirrors 75 in an upward direction onto six second curved mirrors 80 disposed equidistantly around the inner upper perimeter of the circular space 25, and again reflected downward as converging beams 81 onto six motion sensing photo detectors 120 of a construction as described above in connection with the description of the second embodiment of the present invention. The beams are still converging in the vertical plane after being reflected by the plane mirrors. The degree of convergence is designed such that the rays come to a focal point in the vertical plane exactly at a point where the six motion sensing photo detectors 120 are disposed near the upper part of the housing. The detectors are disposed with their longitudinal axis in a position defined by the intersection of two planes, one vertical plane defined by the vertical central axis of the housing and projecting radially through the center of each of the six second mirrors 80, the other plane defined by the focal point of the converging light rays and perpendicular to the line from said focal point to the center of each of said second mirrors.

As a result of the positioning and construction of the elements: reflecting cone 28, mirrors 75 and 80 and the photo detectors 120 as described above, the beam of light when at rest will be focused at a point at the exact center of the photo detector. Sound waves entering any of the apertures 115 will impart part of their energy to corresponding mirror 75 and cause it to pivot in a small alternating motion, thereby causing the focal point of light on the photo detector to move in an alternating linear motion along the light sensitive path on the photo detector.

As a result, each photo sensor will generate, by means of the circuitry attached thereto, and described above, an alternating electrical signal which represents the incident sound waves.

I claim:

1. A microphone for converting sound waves into corresponding electrical signals comprising:

an inner housing;

an outer housing extending around said inner housing, said outer and inner housings defining a space between them;

a laser operatively arranged to project coherent monochromatic light into said space between the outer and inner housings;

light reflective means for reflecting the light from said laser in said space;

said outer housing having a plurality of openings for admitting sound to modulate the light in said space;

said openings disposed equidistantly along the perimeter of said outer housing and in a generally horizontal plane, said openings numbered sequentially, beginning with number one;

and a plurality of electro-optical photo detectors exposed to the modulated light at different locations in said space;

said plurality of photo detectors equal to said plurality of openings, and numbered sequentially, beginning with number one, each photo detector operatively responsive to each same numbered opening.

2. A microphone according to claim 1, wherein:

said inner housing has a cylindrical side wall;

and said outer housing has a cylindrical side wall surrounding said side wall of the inner housing substantially coaxially.

3. A microphone according to claim 2, wherein said openings in the outer housing are located in its cylindrical side wall at substantially equidistantly spaced locations circumferentially.

4. A microphone according to claim 1, wherein:

said laser projects light of such a wave length that it has a high degree of absorption in the atmosphere;

and said light reflective means comprises a plurality of light reflective surfaces positioned to reflect the light from the laser repeatedly to substantially fill said space with diffused light.

5. A microphone according to claim 4, wherein said light reflective means comprises reflective coatings on the inside of said outer housing and on the outside of said inner housing facing said space between them.

6. A microphone according to claim 5, wherein said laser is located in said space between the outer and inner housings.

7. A microphone according to claim 6, wherein said photo detector means comprises a plurality of photo detectors mounted on said inner housing and exposed to the light in said space between the outer and inner housings.

8. A microphone according to claim 7, wherein:

said openings are spaced circumferentially around said outer housing substantially equidistantly;

and said photo detectors are spaced circumferentially around said inner housing substantially equidistantly.

9. A microphone according to claim 8 and having the same number of said photo detectors as said openings.

10. A microphone according to claim 9, wherein each of said photo detectors is substantially aligned with a corresponding opening laterally of said outer and inner housings.

11. A microphone according to claim 10, wherein:

said inner housing has a cylindrical side wall in which said photo detectors are located;

and said outer housing has a cylindrical side wall in which said openings are located, and said side wall of the outer housing surrounds said side wall of the inner housing substantially coaxially.

12. A microphone according to claim 11, and further comprising:

a first end wall extending across and joined to said side walls of both said inner and outer housing at one end thereof;

an opposite end wall on said outer housing extending across and joined to said side wall of said outer housing at the latter's opposite end;

and an opposite end wall on said inner housing extending across and joined to said side wall of said inner housing at the latter's opposite end in spaced parallel relationship to said opposite end wall on said outer housing.

13. A microphone according to claim 12 wherein said reflective coatings are on the inside of said first end wall between the cylindrical side walls of said outer and inner housings, the inside of said cylindrical side wall of said outer housing, the inside of said opposite end wall of said outer housing, the outside of said cylindrical side wall of said inner housing, and the outside of said opposite end wall of said inner housing.

14. A microphone according to claim 5, wherein said photo detectors are mounted on said inner housing and are exposed to the light in said space between the outer and inner housings.

15. A microphone according to claim 14, wherein:

said outer housing has an annular side wall with said openings formed therein at substantially equidistant locations circumferentially;

said inner housing has an annular side wall spaced inward from said annular side wall of the outer housing;

and said photo detectors are mounted on said annular side wall of the inner housing in lateral alignment individually with corresponding openings in said annular side wall of the outer housing.

16. A microphone according to claim 15 wherein:

said laser is mounted to project light into said space oblique to said side walls of the outer and inner housings.

17. A microphone according to claim 1, wherein said light reflective means comprises a plurality of mirrors positioned to reflect and focus light from said laser onto said photo detector means.

18. A microphone according to claim 17, wherein said photo detectors are in said space between the outer and inner housings.

19. A microphone according to claim 1 wherein:

said laser is positioned inside said inner housing and emits coherent monochromatic laser light of such a wave length that a beam of said light exhibits a high degree of refraction in the atmosphere when traversing a pressure gradient in the atmosphere;

said inner housing has circumferentially spaced openings spaced from said laser;

said reflective means includes a reflective member positioned inside said inner housing to reflect light coming from the laser through said openings in the inner housing into said space between the outer and inner housings;

and said reflective means also includes first mirrors in said space for reflecting light passing through said openings in the inner housing and second mirrors for focusing the reflected light on said photo detectors.

20. A microphone according to claim 19, wherein:

said openings in the inner housing are equal in number to said openings in the outer housing;

said photo detectors are equal in number to said openings in the inner housing;

said first mirrors are equal in number to said openings in the inner housing;

said second mirrors are equal in number to said first mirrors;

each of said first mirrors has a concave reflective surface and is positioned to reflect the laser light beam passing through a corresponding opening in the inner housing to a corresponding second mirror through a convergence substantially aligned with a corresponding opening in the outer housing;

and each of said second mirrors has a concave reflective surface and is positioned to reflect the beam of laser light coming from the corresponding first mirror and focus said laser light on a corresponding photo detector.

21. A microphone according to claim 20, wherein:
each of said openings in the inner housing is at the same circumferential position as a corresponding opening in the outer housing;
and each of said first mirrors is radially aligned with a corresponding opening in the inner housing.

22. A microphone according to claim 21, wherein:
each of said openings in the inner housing has an oblong rectangular shape;
and each of said photo detectors is an operative to produce an electrical output signal which varies with the position of the light beam impinging on it.

23. A microphone according to claim 22 wherein:
each of said photo detectors has an elongated tapered light sensitive surface such that a light spot traveling along said elongated surface from a rest position near the midway position of said travel will produce across a pair of output terminals an electric potential that is linearly proportional to the distance of travel from said rest position.

24. A microphone according to claim 22, wherein:
each of said photo detectors has two elongated tapered light sensitive surfaces disposed with their axes on one straight line with their apices opposing each other and in close proximity;
said apices forming a rest position for said light spot;
a conducting base supporting said light sensitive surface;
and three terminals, the first and second conductively connected to each of said light sensitive surfaces and the third connected to said conducting base such that as said light spot travels along said surfaces in an oscillating motion from said rest position an electrical potential that is linearly proportional to the distance of the light spot from said rest position and of a polarity dependent upon whether the light spot is on one or the other of said two light sensitive surfaces.

25. A microphone according to claim 19, wherein:
said laser is positioned at one end of said inner housing;
and said reflective member is at the opposite end of said inner housing and presents a conical reflective surface facing said laser to reflect the light from the laser laterally through said openings in the inner housing.

26. A microphone according to claim 25, and further omprising:
a concave lens of a material transparent to laser light disposed coaxially between said laser and said reflective member, said concave lens operating to disperse parallel rays of the light incident to said lens so that the rays exiting therefrom are diverging as if they were emitting from a point source;
and a convex lens of a material transparent to laser light disposed coaxially between said concave lens and said reflective member, said convex lens operating to converge the diverging rays of light exiting from said concave lens and of such a curvature that the converging rays are again parallel, but with an enlarged cross-sectional area.

27. A microphone according to claim 26, wherein:
said openings in the inner housing are equal in number to said openings in the outer housing, and each of said openings in the inner housing is at the same circumferential position as a corresponding opening in the outer housing;
said first mirrors are equal in number to said openings in the inner housing, and each of said first mirrors is radially aligned with a corresponding opening in the inner housing;
said second mirrors are equal in number to said first mirrors;
said photo detectors are equal in number to said openings in the inner housing;
each of said first mirrors has a concave reflective surface and is positioned to reflect the light beam passing through a corresponding opening in the inner housing to a corresponding second mirror through a convergence substantially aligned with a corresponding opening in the outer housing;
and each of said second mirrors has a concave reflective surface and is positioned to reflect the beam of laser light coming from the corresponding first mirror and focus said laser light on a corresponding photo detector.

28. A microphone according to claim 27, wherein each of said photo detectors is operative to produce an electrical output signal which varies with the position of the beam of laser light impinging upon it.

29. A microphone according to claim 1, wherein:
said laser is positioned inside said inner housing;
said inner housing has circumferentially spaced openings spaced from said laser;
said reflective means includes a reflective member positioned inside said inner housing to reflect light coming from the laser through said openings in the inner housing toward said openings in the outer housing;
and said reflective means also includes mirrors suspended inside said openings in the outer housing and movable in response to sound waves coming in said last-mentioned openings, said mirrors having reflective surfaces positioned to reflect the beams of light passing through said openings in the inner housing.

30. A microphone according to claim 29, wherein said reflective means also includes additional mirrors having concave reflective surfaces positioned to reflect the beams of light coming from said suspended mirrors and focus said beams on said photodetectors.

31. A microphone according to claim 30, wherein:
said openings in the inner housing are equal in number to said openings in the outer housing, and each of said openings in the inner housing is at the same circumferential position as a corresponding opening in the outer housing;
said suspended mirrors are equal in number to said openings in the outer housing;
said additional mirrors are equal in number to said suspended mirrors, and each of said additional mirrors is positioned to reflect a beam of light coming from a corresponding suspended mirror;
and said photo detectors are equal in number to said additional mirrors and are each positioned to receive a beam of light reflected from a corresponding additional mirror.

32. A microphone according to claim 31, wherein:
said laser is at one end of said inner housing;

and said reflective means includes a reflective member positioned inside said housing at its opposite end and presenting a conical reflective surface for reflecting light coming from said laser laterally to said openings in the inner housing.

33. A microphone according to claim 20, wherein each of said photo detectors is operative to produce an electrical output signal which varies with the position of the light beam impinging on it.

34. A microphone according to claim 33, wherein:

each of said photo detectors has an elongated tapered light sensitive surface such that a light spot traveling along said elongated surface from a rest position near the midway position of said travel will produce across a pair of output terminals an electric potential that is linearly proportional to the distance of travel from said rest position.

35. A microphone according to claim 33, wherein:

each of said photo detectors has two elongated tapered light sensitive surfaces disposed with their axes on one straight line with their apices opposing each other and in close proximity;

said apices forming a rest position for said light spot;

a conducting base supporting said light sensitive surface;

and three terminals, the first and second conductively connected to each of said light sensitive surfaces and the third connected to said conducting base such that, as said light spot travels along said surfaces in an oscillating motion from said rest position an electrical potential that is linearly proportional to the distance of the light spot from said rest position and of a polarity dependent upon whether the light spot is on one or the other of said two light sensitive surfaces.

36. A sound system comprising:

a microphone as recited in claim 1;

a plurality of amplifiers connected individually to said photo detectors;

and a plurality of loudspeakers operatively connected individually to the outputs of said amplifiers and positioned to broadcast the amplified sound in different directions.

37. A sound system according to claim 36, wherein each of said loudspeakers is operatively arranged to broadcast the amplified sound in a predetermined direction corresponding to the direction in which the sound entered the microphone through a corresponding opening in its outer housing.

* * * * *